United States Patent [19]

Klein

[11] Patent Number: 4,742,914

[45] Date of Patent: May 10, 1988

[54] PACKAGE

[75] Inventor: Stephen Klein, Fort Lee, N.J.

[73] Assignee: Concept Packaging Inc., Fort Lee, N.J.

[21] Appl. No.: 858,201

[22] Filed: May 1, 1986

[51] Int. Cl.[4] ..... B65D 73/00

[52] U.S. Cl. ..... 206/461; 206/806

[58] Field of Search ..... 206/806, 461, 462, 463, 206/464

[56] References Cited

U.S. PATENT DOCUMENTS

| | | | |
|---|---|---|---|
| 2,990,096 | 6/1961 | Crosby | 206/806 |
| 3,937,328 | 2/1976 | Gordon | 206/806 |
| 4,146,128 | 3/1979 | Hogg et al. | 206/806 |
| 4,219,140 | 8/1980 | Simonoff | 206/806 |
| 4,349,102 | 3/1982 | Strongwater | 206/806 |
| 4,373,632 | 2/1983 | Van Zandt | 206/806 |
| 4,402,423 | 3/1983 | Skowronski et al. | 206/806 |
| 4,452,003 | 6/1984 | Deutsch et al. | 206/806 |
| 4,632,242 | 12/1986 | Choi et al. | 206/806 |

FOREIGN PATENT DOCUMENTS

| | | | |
|---|---|---|---|
| 1031727 | 5/1978 | Canada | 206/806 |

*Primary Examiner*—Joseph Man Fu Moy

*Attorney, Agent, or Firm*—Hedman, Gibson, Costigan & Hoare

[57] ABSTRACT

A package for displacing an item and the package comprises a semi-rigid plastic member which includes a bottom and sides extending upwardly from the bottom and terminating in a continuous edge. A flexible plastic cover non-releasably secures to the continuous edge. The package includes a J-hook configured in the extension of one side of the package. The J-hook further comprises a reinforcing recess.

5 Claims, 3 Drawing Sheets

PACKAGE

FIELD OF THE INVENTION

The present invention relates to a package for accommodating product to be marketed. More particularly, the present invention is directed to a package for marketing consumer products that are beneficially displayed on pipe racks or rods.

BACKGROUND OF THE INVENTION

Many package designs have been created to display consumer items. Naturally, the packages are usually designed to enhance the display of the items and protect the item from damage due to handling.

Currently, consumer items are packaged in many ways. For example, an item such as a shower curtain is packaged in cardboard boxes that are closed by conventional flaps. Typically, the packages for shower curtains can be opened to allow examination of the contents and replacement of the contents.

SUMMARY OF THE INVENTION

It is an object of this invention to provide a display package which is sturdy and attractive.

It is another objective of the invention to provide a package having transparent members through which at least a portion of the items within the box can be seen by shoppers.

It is a further object of the present invention to provide a display package that can be hung from a pipe rack, rod or similar horizontally disposed member located in a sales display area and withstand repeated removal from and replacement to the rod.

It is a still further object of the invention to provide a package that must be destroyed to enable access to the contents of the package.

To this end, a package of formable transparent plastic is formed into an item containing member or receptacle having vertical sides and a bottom, the vertical sides having edges at the top that form a continuous edge. A second transparent plastic member is sealed to the continuous edge at the top in a non-releasable manner. An additional member extends from one of the sides and has a hook-shaped opening formed therein. The hook-shaped opening is reinforced by a unique design in the extension to enable the package to be hung from a pipe rack or rod like member with relatively heavy contents in the package. An insert substantially fitting the configuration of the receptacle is provided to offer sturdiness to the package and to protect the contents of the package.

DESCRIPTION OF THE DRAWINGS

The invention will be better understood when viewed with the drawings wherein.

DESCRIPTION OF THE PREFERRED EMBODIMENT

Figure 1:
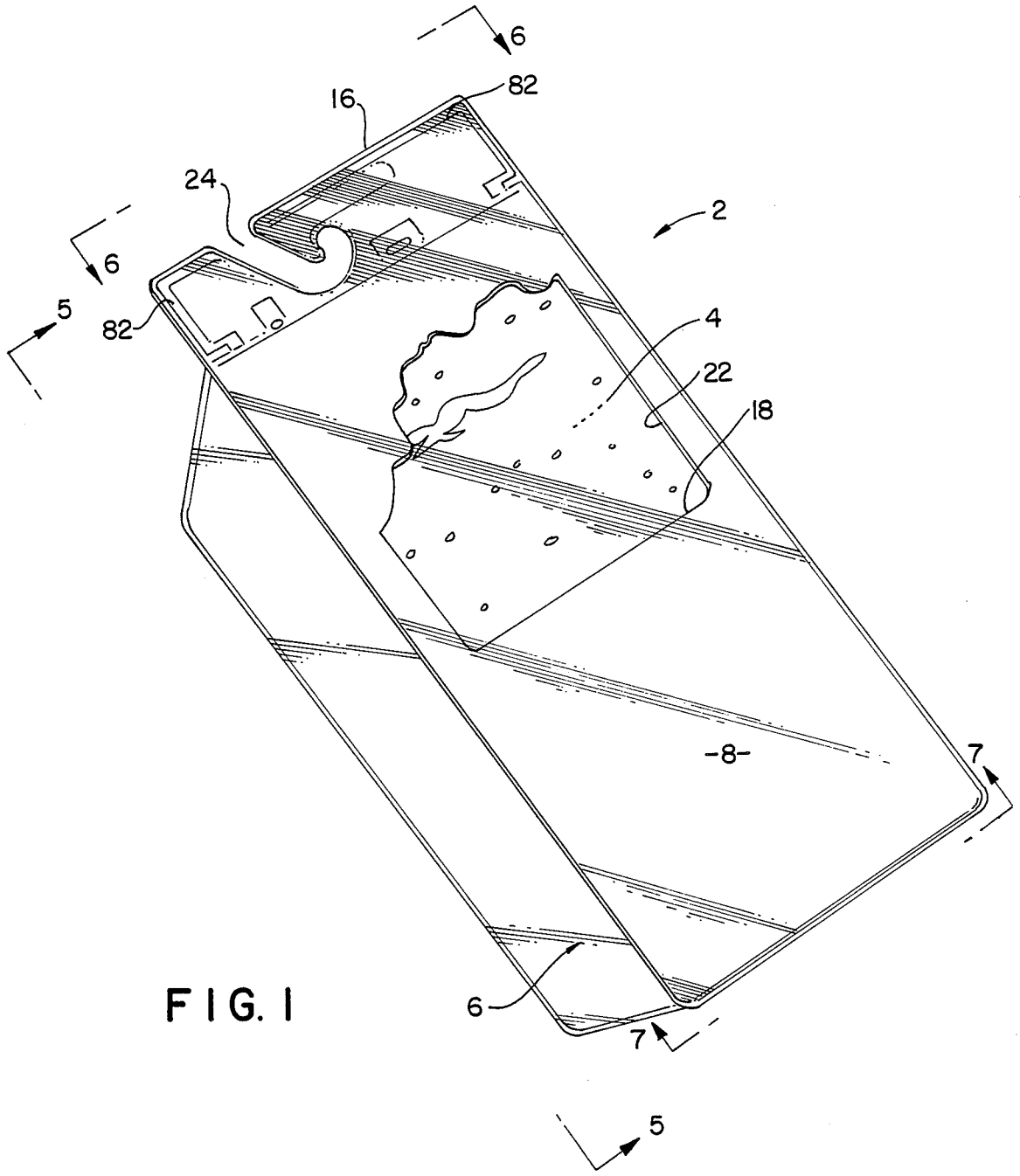
FIG. 1 is an isometric view of the display package of the present invention.
Figure 3:
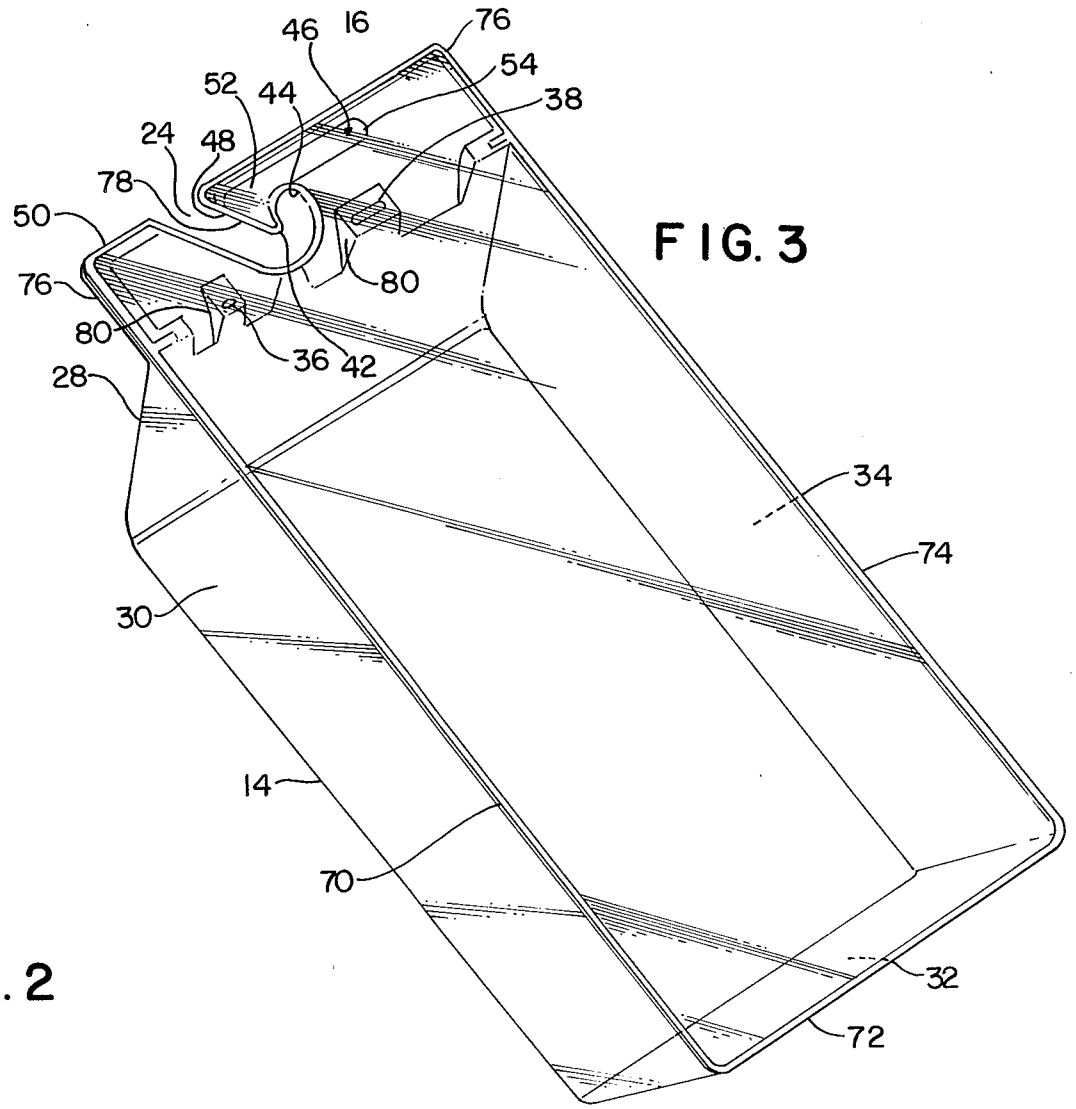
FIG. 3 is an isometric view of the present invention without the insert of FIG. 4 or contents of the package.

The package 2 of the present invention is shown in FIG. 1 having application as a package for a shower curtain 4. In the embodiment of FIG. 1, the package 2 is shown with a receptacle-section 6, a cover 8, an extension 16, an insert 18 and the shower curtain 4 seen through the window 22 of the insert 18.

Figure 2:
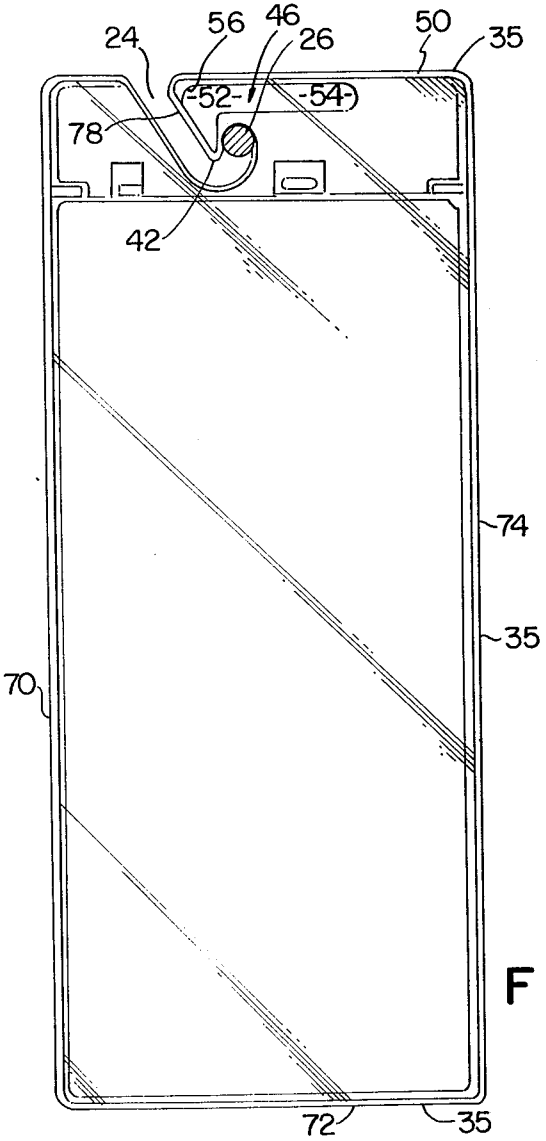
FIG. 2 is an elevational view of the package of the present invention shown suspended on a rod.
Figure 4:
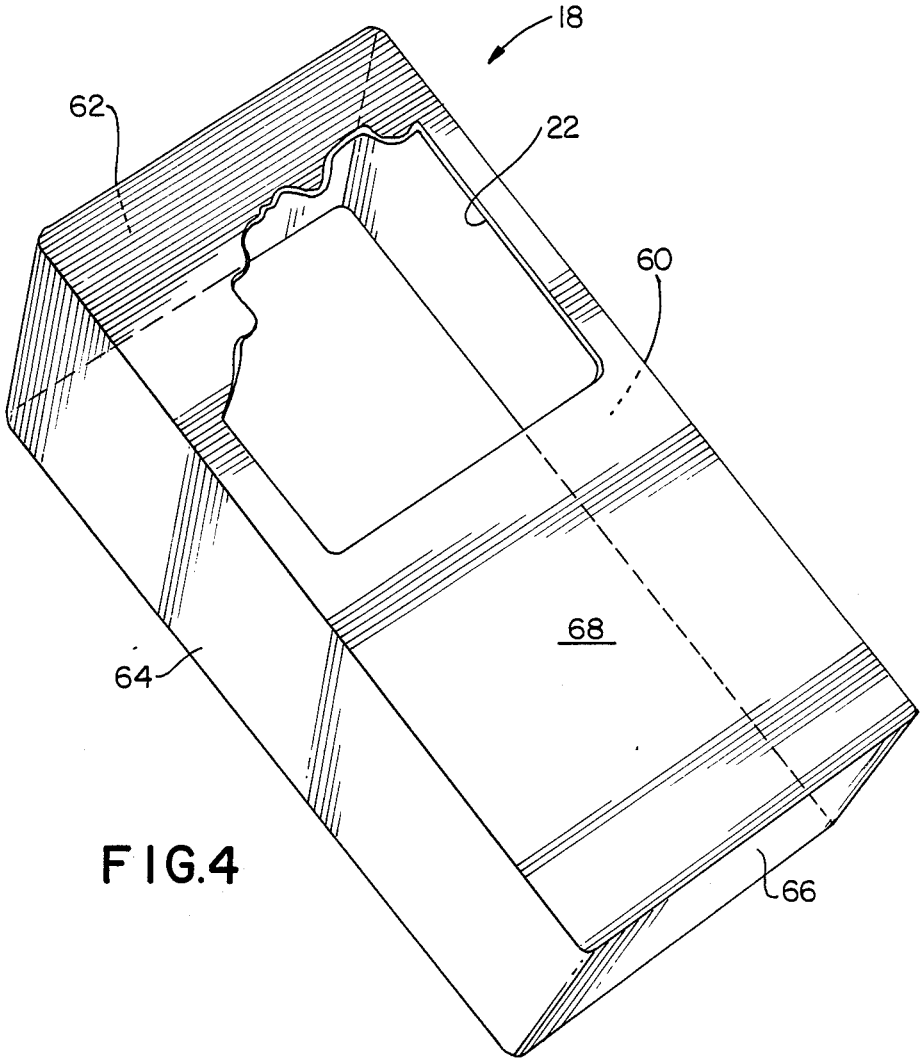
FIG. 4 is an isometric view of an insert of the present invention.
Figure 5:
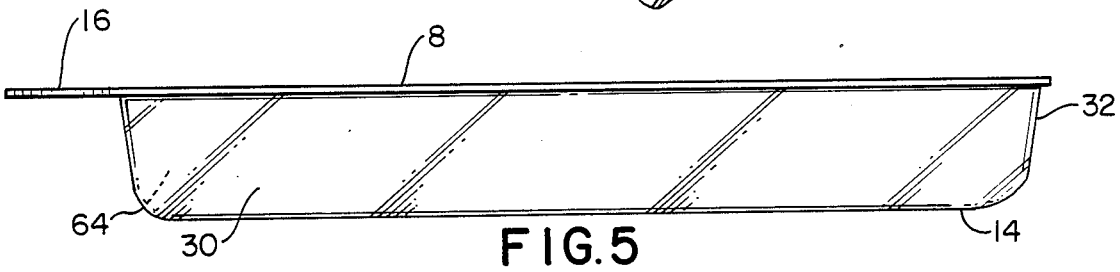
FIG. 5 is a side elevational view of the package of FIG. 1 through line 5—5 of FIG. 1.
Figure 6:
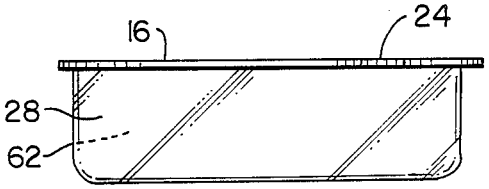
FIG. 6 is a side elevational view of the package of FIG. 1 through line 6—6 of FIG. 1.
Figure 7:
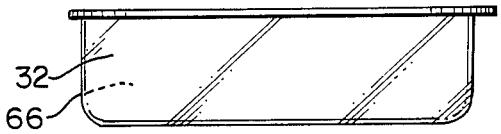
FIG. 7 is a side elevational view of the package of FIG. 1 through line 7—7 of FIG. 1.

An opening in the configuration of a hook 24, or more particularly a J-hook, is formed in the extension 16 to enable mounting of the package 2 on a rod 26, best seen in FIG. 2.

As seen in FIG. 1, the receptacle section 6 and cover 8 are transparent in the preferred embodiment. The receptacle section 6 is formed of a transparent plastic such as polyvinyl chloride (PVC) of 20–30 gauge (0.020–0.030 inch) stock. One method of forming the receptacle section is by vacuum forming into a female die. The formed receptacle section 6 is provided with sides 28, 30, 32 and 34, a bottom 14 and the extension 16. The vacuum forming in a female die provides a continuous edge 35 around sides 28, 30, 32, 34, the extension 16 and the J-hook 24 of essentially the same thickness as the PVC stock used to form the receptacle 6. For example, with 24 gauge (0.024 inch) stock to form the receptacle 6, a continuous edge 35 will be formed of only 0.002–0.003 inch less in thickness; i.e., 0.021–0.022 inch thickness.

Additional surfaces 36 and 38 are formed to create an interrupted edge for the side 28. The opening that forms the hook 24 is formed in the extension 16 to provide a depending point 42 and a bearing surface member 44. A recess 46 is formed in the extension 16 to provide reinforcement for the hook. The recess 46 is configured to follow the downwardly extending edge 48 of the hook 24 to the edge 50 of the extension 16 to form a vertical section 52 and extend parallel with the edge 50 to form a horizontal section 54. It has been found that with a hook edge 48 depending one and one-half inches below the extension edge 50, a vertical recess section 52 of one and one-quarter inches from depending point 42 to edge 50 and a horizontal section 54 of one and seven-eighth inches from the upper corner 56 of the vertical section 52 through the horizontal or transverse section 54 and a recess depth of one-quarter inches will provide a hook 24 that will sustain a shower curtain 4 in package 2 of at least two pounds that is repeatedly removed from and returned to the rod 26. The J-hook configuration facilitates removal and return to the rod mounting.

The package 2 is completed by inserting the item such as the shower curtain 4, and the insert 18 into the receptacle section 6 and sealing the plastic cover 8 to the upper edges 70, 72, 74 of sides 30, 32 and 34 and to the edges 76, 78 and 50 of the extension 16.

The plastic cover 8 is also sealed to the surfaces 36 and 38 that form the interrupted edge of side 28. A process for securing the plastic cover 8 to the edges of the receptacle 6 is the conventional RF frequency-tear seal process.

The package 2 is provided with contoured ribs 80 integrally formed in the area at which the extension 16 attaches to the receptacle section 6. The ribs 80 provide structural strength to facilitate stability between the extension 16 and the receptacle 6. The ribs 80 and reinforcement recess 46 cooperate to enhance the stability of the J-hook 24 and the overall hanging capability to the package 2.

Additional recess areas 82 are formed in the extension 16 to further improve the structural integrity of the package 2 and, in particular, to provide torsional resistance in the extension 16.

Practice has shown that a plastic such as PVC of 10 gauge (0.010 inch) serves well as the cover 8 of the package 2.

The insert 18 is formed of 16 gauge (0.016 inch) conventional cardboard having sides 60, 62, 64 and 66 that depend from the surface 68 of the insert 18 and are sized to conform substantially to the configuration of the sides 28, 30, 32 and 34 of the receptacle 6 as seen in FIGS. 1, 5, 6 and 7. With sides 60, 62, 64 and 66 secured at the edges to the adjacent sides, reinforcement of receptacle 6 is provided and sturdiness of the overall package 2 is enhanced. In the process of producing the package, the insert also serves to protect the shower curtain 4 or other package contents during the RF frequency-tear seal process.

As can be seen from the specification and drawings, changes to the configuration of the package 2 and the constituent parts can be made without departing from the invention.

I claim:

1. A package for displaying an item contained within the package comprising:

(a) a semi-rigid plastic member for accommodating the item, said receptacle member having a bottom and sides extending upwardly from the bottom and which terminate in a continuous edge;

(b) a flexible plastic cover non-releasably secured to the continuous edge;

(c) means for suspending the package from a rod comprising a continuous extension from one side of the receptacle, a hook configured in the extension having a J-hook configuration and a means for reinforcing the hook in the extension comprising a recess formed in the extension material adjacent the depending point of the hook and extending vertically from the depending point of the hook to the edge of the extension and transversely along the edge of the extension, and further comprising ribs formed between the extension and receptacle;

(d) means for enhancing torsional resistance comprising additional recesses in the extension; and (e) an insert for reinforcing the package.

2. A package as in claim 1 wherein the recess section extending vertically is about one and one-half inches in length, the transverse section is one and seven-eighths inches in length and the recess is about one-quarter inch in depth.

3. A package as in claim 1 wherein said insert is comprised of a top surface and depending sides which sides conform substantially to the sides of the receptacle.

4. A package as in claim 3 wherein the receptacle is formed of 20–30 gauge PVC transparent plastic and the cover is of flexible 10 gauge PVC plastic.

5. A package as in claim 4 further comprising a shower curtain within the package.

* * * * *